US011246359B1

(12) United States Patent
Coates

(10) Patent No.: US 11,246,359 B1
(45) Date of Patent: Feb. 15, 2022

(54) FACE MASK WITH ADJUSTABLE STRAPS AND QUICK RELEASE FASTENER

(71) Applicant: Tailored Technologies, Inc., Winston-Salem, NC (US)

(72) Inventor: Fredrica V. Coates, Winston-Salem, NC (US)

(73) Assignee: Tailored Technologies, Inc., Winston-Salem, NC (US)

( * ) Notice: Subject to any disclaimer, the term of this patent is extended or adjusted under 35 U.S.C. 154(b) by 0 days.

(21) Appl. No.: 17/085,764

(22) Filed: Oct. 30, 2020

(51) Int. Cl.
*A41D 13/11* (2006.01)

(52) U.S. Cl.
CPC ..... *A41D 13/1161* (2013.01); *A41D 13/113* (2013.01)

(58) Field of Classification Search
CPC ..... A41D 13/11; A41D 13/1107; A41D 13/1161; A41D 13/113; A61M 16/06; A61M 16/0093; A61M 16/047; A61M 16/0605; A61M 16/0683; A61F 2013/00476
USPC ..... 128/203.29, 203.25, 206.12, 206.19, 128/206.21, 206.28, 863, 206.13, 207.11, 128/207.17, 857, 858; 2/424, 206, 9, 2/410; 602/17, 74
See application file for complete search history.

(56) References Cited

U.S. PATENT DOCUMENTS 2,149,067 A * 2/1939 Otero ..... A41D 13/11 128/863
3,013,556 A * 12/1961 Galleher, Jr. ..... A62B 18/084 128/207.11
3,664,335 A * 5/1972 Boucher ..... A41D 13/1192 128/206.19
5,265,280 A * 11/1993 Walsh ..... A41D 13/11 128/206.12
5,517,986 A * 5/1996 Starr ..... A61M 16/06 128/201.23
5,819,731 A * 10/1998 Dyrud ..... A41D 13/1146 128/206.27
6,644,314 B1 * 11/2003 Elsberg ..... A41D 13/11 128/205.27
2017/0065036 A1 * 3/2017 Castiglione ..... A44B 11/263

* cited by examiner

*Primary Examiner* — Caitlin A Carreiro
(74) *Attorney, Agent, or Firm* — Suiter Swantz pc llo

(57) ABSTRACT

A face mask according to the present disclosure includes a main body for being worn to cover a wearer's mouth and nose and right and left adjustable straps affixed along respective right and left lateral extents of the main body, each adjustable strap including a continuous length of material having opposing first and second ends and a first loop formed at the first end, wherein the second end is threaded through the first loop to form an ear loop for being positioned around an ear of the wearer such that, in use, the second end is pulled to tighten the ear loop to adjust the fit of the face mask. In some implementations, the main body may include a middle portion disposed between elastic fabric side portions.

8 Claims, 4 Drawing Sheets

FACE MASK WITH ADJUSTABLE STRAPS AND QUICK RELEASE FASTENER

BACKGROUND

Current studies suggest that certain viruses (e.g., coronaviruses) can persist on surfaces and can be transmitted through respiratory droplets. Current studies also suggest that personal protective equipment (PPE) is effective at mitigating the spread of viruses. While PPE is less critical in outdoor environments where physical separation (e.g., social distancing) can be practiced, indoor environments such as hospitals, schools, airports and vehicles are high-risk environments for viral transmission due to confined spaces, recirculated air, and close proximity of people, often for long time durations.

Face masks have been proven effective at mitigating the spread of viruses due to their ability to block small respiratory droplets that are projected when coughing, sneezing, and speaking. To be effective, their use must be continuous when physical separation is not possible, and they must remain in tight-fitting engagement on the face covering both the mouth and nose of the wearer. Conventional face masks typically include either non-elastic straps that tie together behind the head, or elastic ear loops which engage the ears. While the former can be adjusted by untying and retying the straps, doing so requires working behind the head and thus it is difficult for most wearers to achieve a correct fit, especially children, the elderly, and those with limited manual dexterity. While the latter is easier to install, elastic ear loops tend to be undersized to accommodate different head sizes and therefore pull the ears forward and become uncomfortable over time for most wearers. Importantly, neither solution allows the face mask to be lowered away from the face and then raised back into position while being easily adjusted to achieve the correct fit.

Accordingly, what is needed is an improved face mask that is easily adjustable, comfortable to wear, and provides better face coverage, among other advantages.

BRIEF SUMMARY

To achieve the foregoing and other advantages, in a first embodiment the present disclosure provides a face mask including a main body for being worn to cover a wearer's mouth and nose, a right adjustable strap affixed along a right lateral extent of the main body, the right adjustable strap including a continuous length of material having opposing first and second ends and a first loop formed at the first end, wherein the second end is threaded through the first loop to form a right ear loop to be positioned around a right ear of the wearer, and wherein the second end is pulled to close the right ear loop to tighten around the right ear, and a left adjustable strap affixed along a left lateral extent of the main body, the left adjustable strap including a continuous length of material having opposing first and second ends and a first loop formed at the first end, wherein the second end is threaded through the first loop to form a left ear loop to be positioned around the left ear of the wearer, and wherein the second end is pulled to close the left ear loop to tighten around the left ear.

In some embodiments, the main body may include a middle portion centrally disposed between a right portion and a left portion.

In some embodiments, the right portion may include elastic fabric affixed along a first side to the middle portion, along a second side to the right adjustable strap, along an upper peripheral portion to an upper elastic strap, and along a lower peripheral portion to a lower elastic strap, and the left portion may include elastic fabric affixed along a first side to the middle portion, along a second side to the left adjustable strap, along an upper peripheral portion to an upper elastic strap, and along a lower peripheral portion to a lower elastic strap.

In some embodiments, the middle portion may have a first predetermined extensibility and the elastic fabric of each of the right and left portions may have a second predetermined extensibility, wherein the second predetermined extensibility is greater than the first predetermined extensibility.

In some embodiments, the middle portion may have a first predetermined porosity and the elastic fabric of each of the right and left portions may have a second predetermined porosity, wherein the second predetermined porosity is greater than the first predetermined porosity.

In some embodiments, the upper elastic strap of the right portion may extend from the middle portion to the right adjustable strap, the lower elastic strap of the right portion may extend from the middle portion to the right adjustable strap, the upper elastic strap of the left portion may extend from the middle portion to the left adjustable strap, and the lower elastic strap of the left portion may extend from the middle portion to the left adjustable strap.

In some embodiments, the main body may include at least two layers and each of the right and left portions may include a single layer.

In some embodiments, a second loop may be formed at the second end of the right adjustable strap securing a first fastening element to the second end of the right adjustable strap, and a second loop may be formed at the second end of the left adjustable strap securing a second fastening element to the second end of the left adjustable strap, wherein the first fastening element is received in the second fastening element to secure the first and second fastening elements together.

In some embodiments, the first fastening element may include a tongue, the second fastening element may include a buckle, and the second fastening element may include an actuator for releasing the tongue from locked engagement in the buckle.

In some embodiments, each of the right and left adjustable straps may be elastic, and each of the first and second loops of each of the right and left adjustable straps may be formed by folding over the respective end and sewing across a width of the respective end to form the respective loop.

In some embodiments, the face mask may further include an elongate malleable metal bar provided in an upper peripheral portion of the main body.

In a second embodiment the present disclosure provides a face mask including a main body for being worn to cover a wearer's mouth and nose, a right portion affixed to the main body along a right lateral extent of the main body, the right portion including elastic fabric provided between main body, an upper elastic strap, a lower elastic strap, and a right adjustable strap, and a left portion affixed to the main body along a left lateral extent of the main body, the left portion including elastic fabric provided between the main body, an upper elastic strap, a lower elastic strap, and a left adjustable strap, wherein the right adjustable strap includes a continuous length of material having opposing first and second ends and a first loop formed at the first end, wherein the second end is threaded through the first loop to form a right ear loop to be positioned around a right ear of the wearer, and wherein the second end is pulled to close the right ear loop to tighten around the right ear, and wherein the left adjustable strap includes a continuous length of material having opposing first and second ends and a first loop formed at the first end, wherein the second end is threaded through the first loop to form a left ear loop to be positioned around the left ear of the wearer, and wherein the second end is pulled to close the left ear loop to tighten around the left ear. In use, the right and left ear loops are adjusted for fit and comfort.

This brief summary is provided solely as an introduction to subject matter that is fully described in the detailed description and illustrated in the drawings. This brief summary should not be considered to describe essential features nor be used to determine the scope of the claims. Moreover, it is to be understood that both the foregoing summary and the following detailed description are exemplary and explanatory only and are not necessarily restrictive of the subject matter claimed.

BRIEF DESCRIPTION OF THE DRAWINGS

The detailed description is described with reference to the accompanying figures. The use of the same reference numbers in different instances in the description and the figures may indicate similar or identical items. Various embodiments or examples ("examples") of the present disclosure are disclosed in the following detailed description and the accompanying drawings. The drawings are not necessarily to scale. In the drawings.

DETAILED DESCRIPTION

Figure 1:
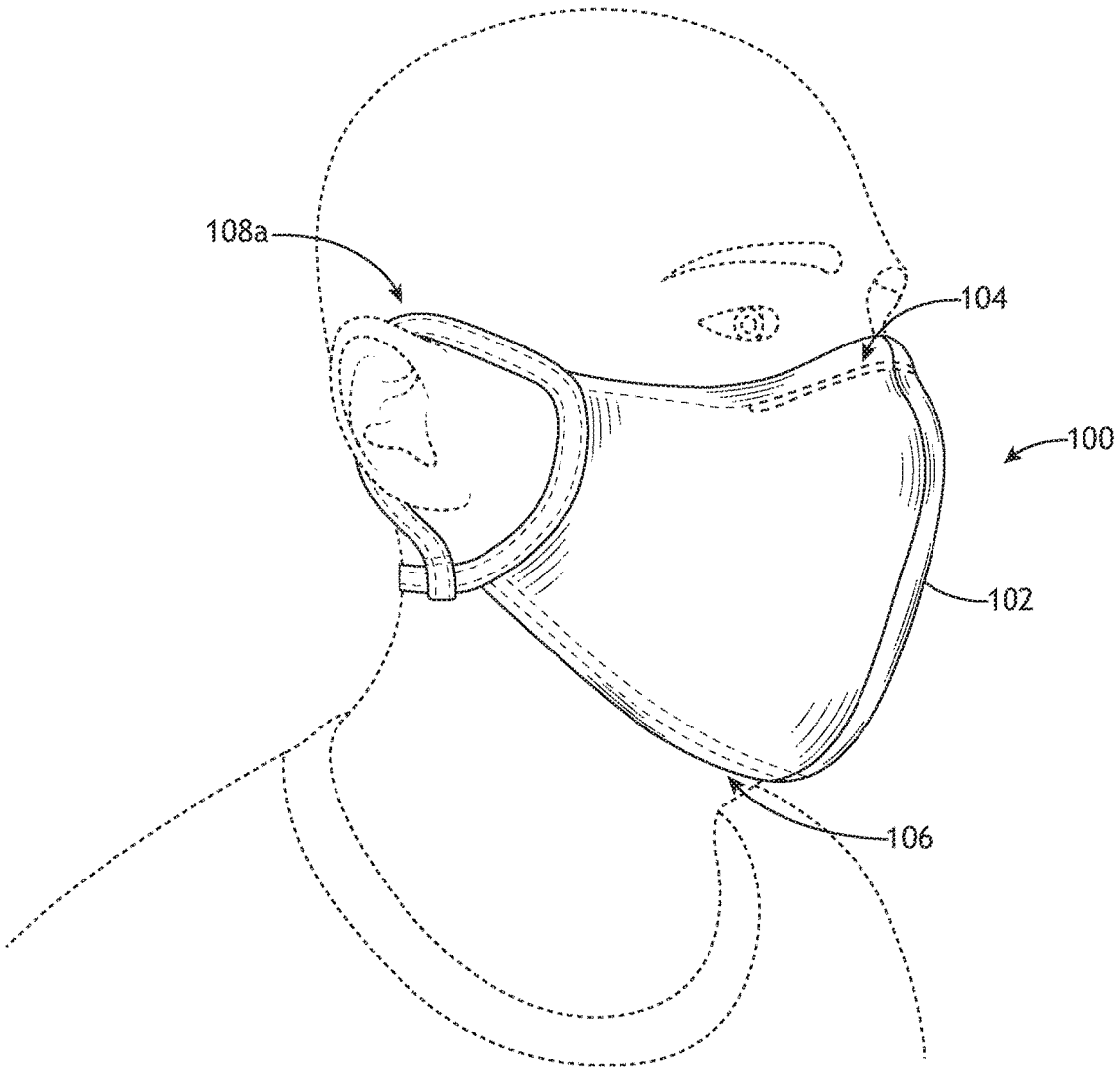
FIG. 1 is a perspective view of a face mask according to a first embodiment shown being worn.

Before explaining one or more embodiments of the disclosure in detail, it is to be understood that the embodiments are not limited in their application to the details of construction and the arrangement of the components set forth in the following description or illustrated in the drawings. In the following detailed description of embodiments, numerous specific details may be set forth to provide a more thorough understanding of the disclosure. However, it will be apparent to one of ordinary skill in the art having the benefit of the instant disclosure that the embodiments disclosed herein may be practiced without some of these specific details. In other instances, well-known features may not be described in detail to avoid unnecessarily complicating the instant disclosure.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only and should not be construed to limit the disclosure in any way unless expressly stated to the contrary.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of "a" or "an" may be employed to describe elements and components of embodiments disclosed herein. This is done merely for convenience and "a" and "an" are intended to include "one" or "at least one," and the singular also includes the plural unless it is obvious that it is meant otherwise.

Finally, as used herein any reference to "one embodiment" or "some embodiments" means that a particular element, feature, structure, or characteristic described in connection with the embodiment is included in at least one embodiment disclosed herein. The appearances of the phrase "in some embodiments" in various places in the specification are not necessarily all referring to the same embodiment, and embodiments may include one or more of the features expressly described or inherently present herein, or any combination or sub-combination of two or more such features, along with any other features which may not necessarily be expressly described or inherently present in the instant disclosure.

Broadly speaking, the present disclosure provides embodiments of face masks having adjustable straps for ensuring proper fit and performance, as well as for enhancing comfort and ease of use, among other aspects and advantages.

Figure 2:
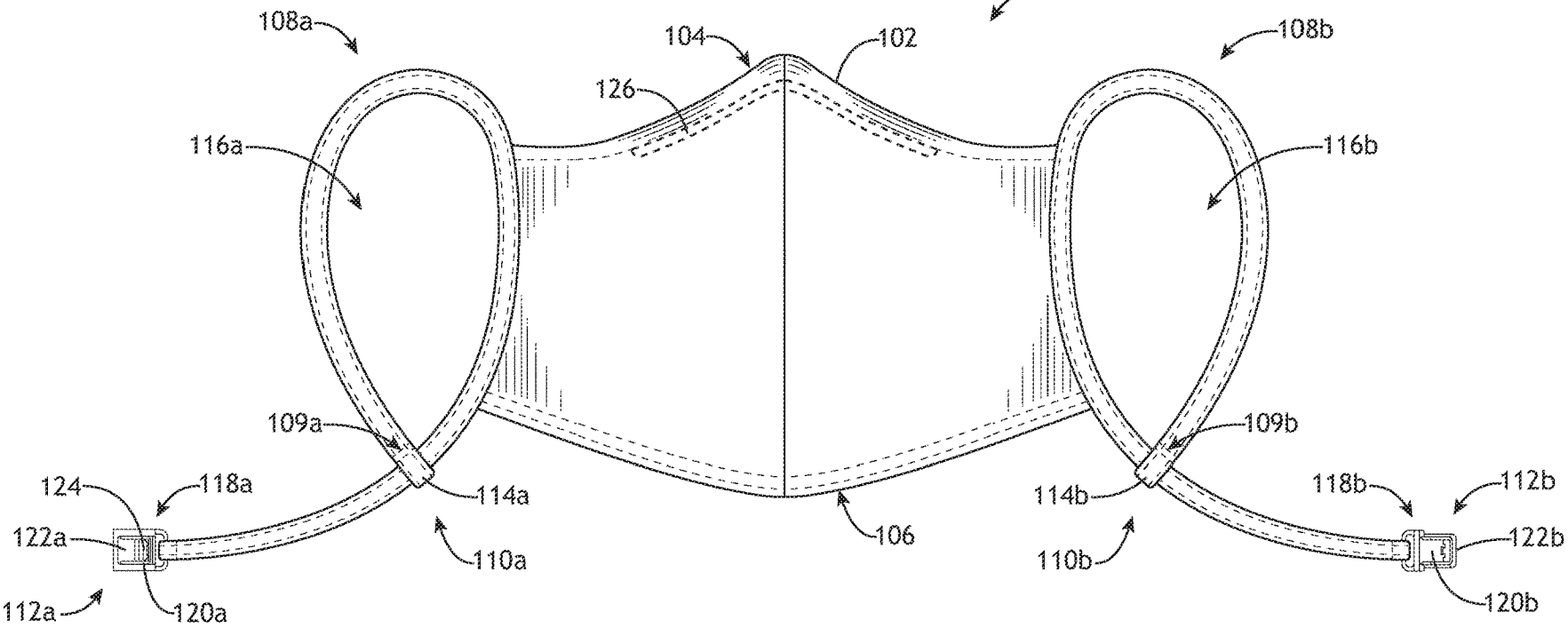
FIG. 2 is a front view of the face mask of FIG. 1.

Referring to FIGS. 1 and 2, a first embodiment of a face mask 100 is shown. FIG. 1 shows the face mask 100 being worn by a wearer, while FIG. 2 shows the face mask 100 folded flat for clarity. In use, the face mask 100 secures in place to cover at least the mouth and nose. In some embodiments, the face mask 100 extends from under the chin to about the bridge of the nose, and from left to right just forward of the ears. Adjustable straps, as discussed further below, secure around the ears and attach at the back of the neck to hold the face mask 100 in place in tight-fitting engagement against the face.

The face mask 100 includes a main body 102 made of, for example, flexible material that generally conforms to the shape of the face. In some embodiments, the material may be a non-woven fabric such as polypropylene and the mask may be disposable. In other embodiments, the material may be woven fabric such as cotton and the mask may be washable and reusable. Other embodiments may include combinations of both material types or other material types provided in at least one layer, and preferably at least two layers including an inner layer and an outer layer. In some embodiments, an intermediate layer such as a filter material may be disposed between the inner and outer layers. The main body 102 as shown includes a right side and a left side stitched together along a centerline bisecting the main body. The upper peripheral portion 104 as shown is peak shaped to conform to the bridge of the nose and curvature of the check bones, and the lower peripheral portion 106 as shown is convex shaped to conform to the lower jaw line. The main body 102 is dimensioned to cover at least the mouth and nose of the wearer.

A right adjustable strap 108*a* is affixed along a right lateral extent of the main body 102. The right adjustable strap 108*a* includes a continuous length of material having a first end 110*a* and an opposing second end 112*a*. In some embodiments, a portion of the length of the adjustable strap extends coextensive with the right side of the main body to provide an elongate attachment. The first end 110*a* terminates in a first loop 114*a*, for instance a circular loop or "lasso." In some embodiments, the first loop 114*a* may be formed by folding back a portion of the first end 110*a* around and against the strap and sewing across the width of the material as shown at stich line 109*a*, for instance two rows of stitches. In some embodiments, the terminal end loops disclosed herein may be diametrically smaller than the width of the strap such that the loop slides 'tightly' along the length of the strap to prevent unintentional loosening. The second end 112*a* is threaded through the first loop 114*a* to form a right ear loop 116*a* to be positioned around a right ear of the wearer. In use, the second end 112*a*, or any portion of the adjustable strap downstream of the first loop 114*a*, is pulled to close (i.e., tighten) the right ear loop to adjust the loop around the right ear. The right ear loop can be opened (i.e., loosened) by pulling a length of strap back through the first loop 114*a*.

A left adjustable strap 108*b* is affixed along a left lateral extent of the main body 102. The left adjustable strap 108*b* includes a continuous length of material having a first end 110*b* and an opposing second end 112*b*. In some embodiments, a portion of the length of the adjustable strap extends coextensive with the left side of the main body to provide an elongate attachment. The first end 110*b* terminates in a first loop 114*b*. In some embodiments, the first loop 114*b* may be formed by folding back a portion of the first end 110*b* around and against the strap and sewing across the width of the material as shown at 109*b*, for instance two rows of stitches. The second end 112*b* is threaded through the first loop 114*b* to form a left ear loop 116*b* to be positioned around a left ear of the wearer. In use, the second end 112*b*, or any portion of the adjustable strap downstream of the first loop 114*b*, is pulled to close (i.e., tighten) the left ear loop to adjust the loop around the left ear. The left ear loop can be opened (i.e., loosened) by pulling a length of strap back through the first loop 114*b*.

In some embodiments, a second loop 118*a* may be formed at the second end 112*a* of the right adjustable strap 108*a* for securing a first fastening element 120*a* to the second end of the right adjustable strap, and a second loop 118*b* may be formed at the second end 112*b* of the left adjustable strap 108*b* for securing a second fastening element 120*b* to the second end of the left adjustable strap. In some embodiments, the first and second fastening elements 120*a*, 120*b* removably attach together to connect the straps about the back of the neck of the wearer to help secure the mask in place.

In some embodiments, the first fastening element 120*a* may be one half of a fastening mechanism and the second fastening element 120*b* may the other half of the fastening mechanism. Examples of fastening mechanisms include, but are not limited to, hook and loop fasteners, snaps, buttons and buttonholes, clips, etc. As shown, the fastening mechanism may be a quick release fastener wherein the first fastening element 120*a* includes a tongue 122*a* and the second fastening element 120*b* includes a buckle 122*b*, wherein the tongue removably engages in the buckle and the second fastening element 120*b* includes an actuator (e.g., button) pressed to release the locked tongue. A quick release fastener allows a wearer to easily locate the tongue in the buckle and release the tongue by depressing with actuator without having to view the fastening mechanism. Other conventional fastening systems can be implemented. The fastening mechanism further allows the mask to remain secured around the wearer's neck with the main body 102 pulled down to a non-use position for eating, speaking, etc. In some embodiments, each of the first and second fastening elements 120*a*, 120*b* are dimensioned larger than their respective first loop 114*a*, 114*b* to prevent the fastening element from being pulled back through the loop unintentionally.

In some embodiments, an elongate malleable metal bar 126 may be provided in the upper peripheral portion 104 of the main body 104. In use, the wearer bends the malleable metal bar 126 by pressing against the bar to conform the bar to the shape of the nose and cheek bones.

Figure 3:
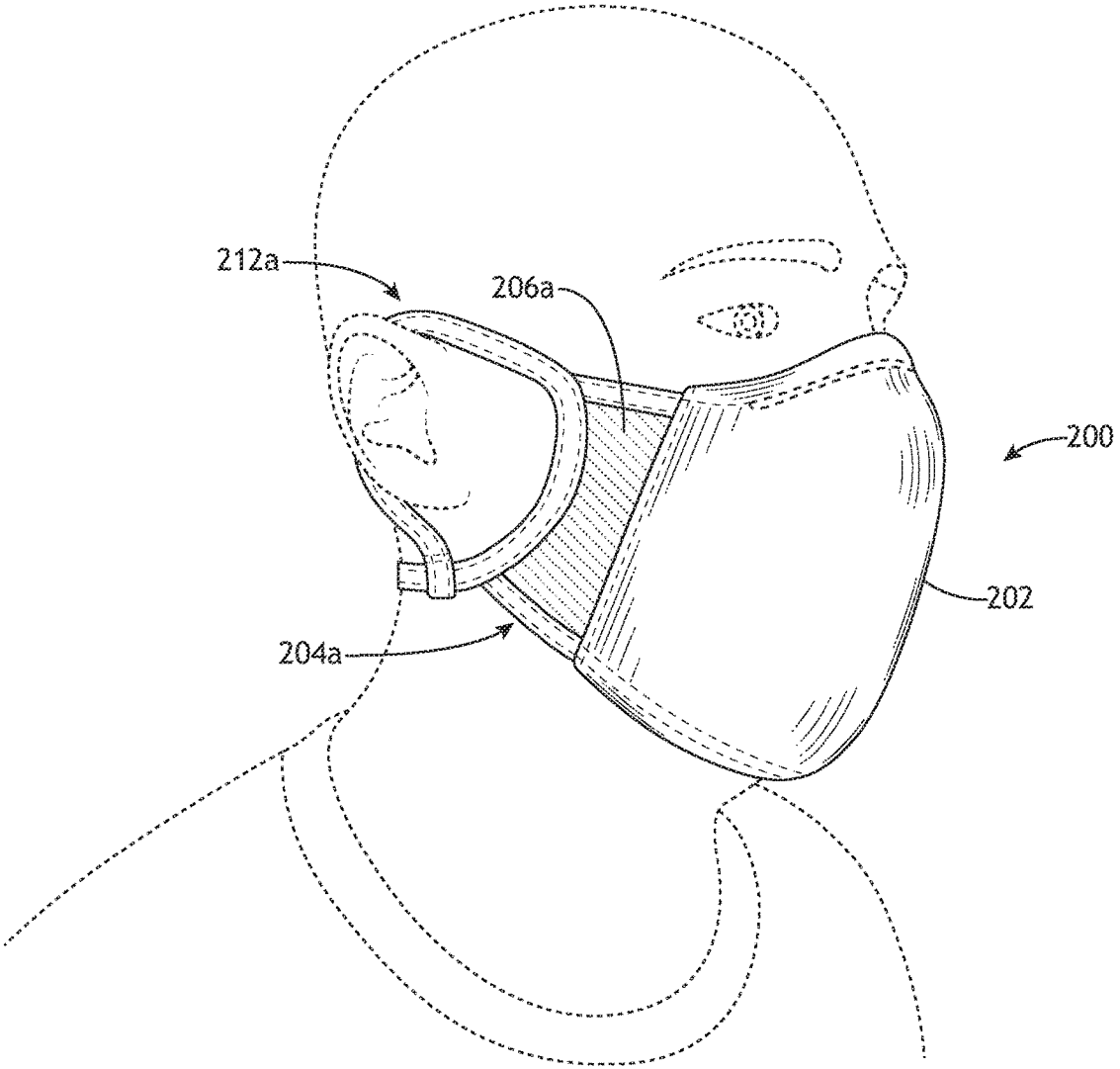
FIG. 3 is a perspective view of a face mask according to a second embodiment shown being worn.
Figure 4:
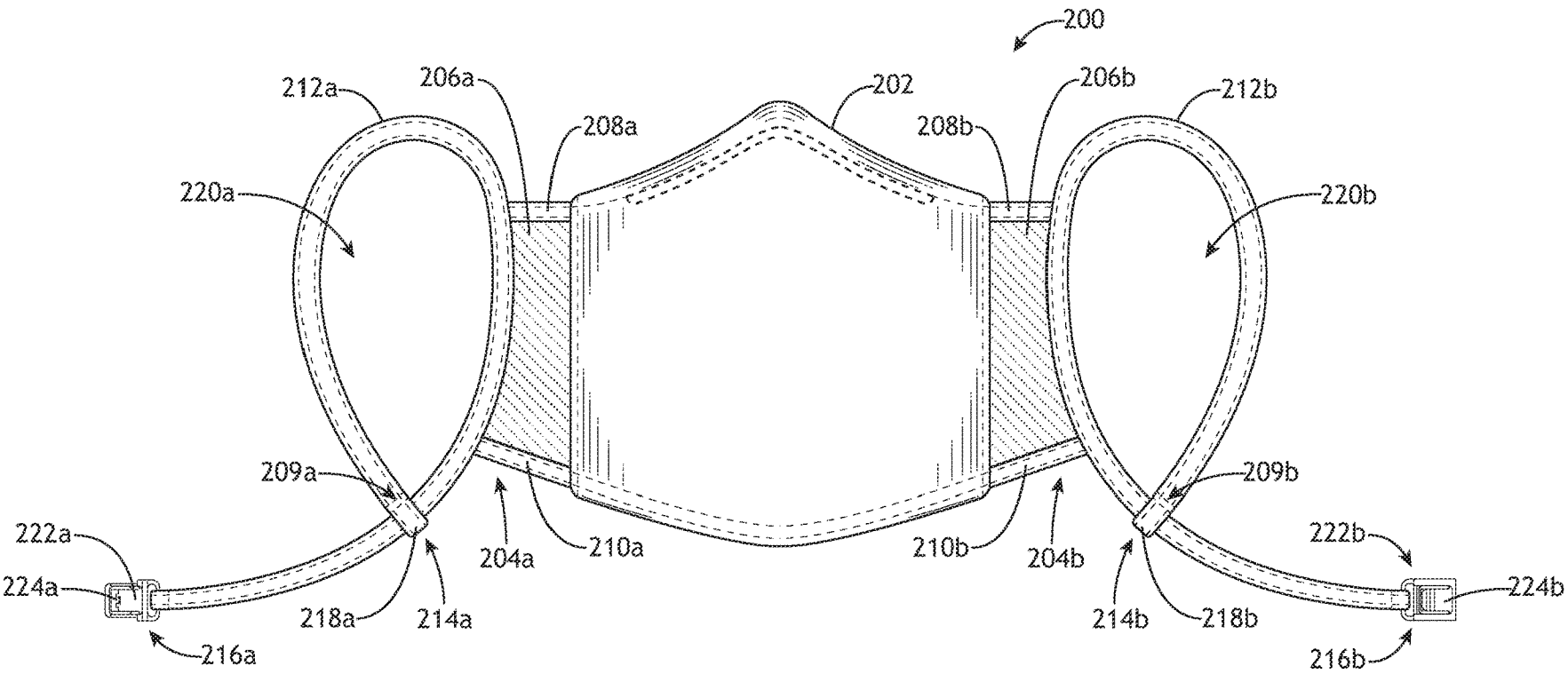
FIG. 4 is a front view of the face mask of FIG. 3.

Referring to FIGS. 3 and 4, a second embodiment of a face mask 200 is shown. FIG. 3 shows the face mask 200 being worn by a wearer, while FIG. 4 shows the face mask 200 folded flat for clarity.

The face mask 200 also includes a main body 202 for covering a wearer's mouth and nose. A right portion 204*a* is affixed to the main body 202 along a right lateral extent of the main body. The right portion 204*a* includes elastic fabric 206*a* provided (i.e., filling the spaced formed between) the right side of the main body 202, an upper elastic strap 208*a*, a lower elastic strap 210*a*, and a right adjustable strap 212*a*. A left portion 204*b* is affixed to the main body 202 along a left lateral extent of the main body. The left portion 204*b* includes elastic fabric 206*b* provided (i.e., filling the spaced formed between) the right side of the main body 202, an upper elastic strap 208*b*, a lower elastic strap 210*b*, and a right adjustable strap 212*b*. In other words, the adjustable strap, upper elastic strap, lower elastic strap, and lateral extent of the main body together form a four-sided frame and the elastic fabric fills the framed spaced and is sewn or otherwise attached to each of the frame members. In this configuration, each of the right and left portions function as side extensions of the main body extending toward their respective ear to further extend the coverage of the face mask and enhance performance.

In some embodiments, the main body 202 has a first predetermined extensibility and the elastic fabric 206*a*, 206*b* of each of the right and left portions 204*a*, 204*b* has a second predetermined extensibility, wherein the second predetermined extensibility is greater than the first predetermined extensibility. For example, the main body 202 may be constructed from a woven fabric and the elastic fabric may be constructed from highly stretchable material such as 4-way stretch nylon net fabric and the like.

In some embodiments, the main body 202 has a first predetermined porosity and the elastic fabric 206*a*, 206*b* of each of the right and left portions 204*a*, 204*b* has a second predetermined porosity, wherein the second predetermined porosity is greater than the first predetermined porosity. For example, the main body 202 may be multilayered and constructed from tight knit fabric(s) to capture/block respiratory droplets about the mouth and nose, whereas the right and left portions 204*a*, 204*b* may be single layered and constructed from open knit fabric for better air transfer.

Like the first embodiment, the second face mask embodiment includes a right adjustable strap 212*a* and a left adjustable strap 212*b*, each adjustable strap including a continuous length of material having a first end 214*a*, 214*b* and an opposing second end 216*a*, 216*b* with a first loop 218*a*, 218*b* formed at the first terminal end, for instance formed by stitching at least one row across the width of the strap as shown at 209*a* and 209*b*, and the second end threaded through the first loop to form respective right and left ear loops 220*a*, 220*b* to be positioned around the right and left ears of the wearer, respectively. Again, the second ends 216*a*, 216*b* are pulled to adjust the straps to tighten around the ears for a comfortable fit as determined by the wearer.

In some embodiments, the upper elastic strap 208*a* of the right portion 204*a* extends from the main body 202 to the right adjustable strap 212*a*, the lower elastic strap 210*a* of the right portion 204*a* extends from the main body 202 to the right adjustable strap 212*a*, the upper elastic strap 208*b* of the left portion 204*b* extends from the main body 202 to the left adjustable strap 204*b*, and the lower elastic strap 210*b* of the left portion 204*b* extends from the main body 202 to the left adjustable strap 212*b*.

Like the first embodiment, a second loop 222*a* may be formed at the second end of the right adjustable strap 204*a* for securing a first fastening element 224*a* to the second end of the right adjustable strap, and a second loop 222*b* may be formed at the second end of the left adjustable strap 204*b* for securing a second fastening element 224*b* to the second end of the left adjustable strap 204*b*. The first and second fastening elements 224*a*, 224*b* may removably attach as discussed above, for instance utilizing a quick release fastening mechanism.

It is to be understood that the foregoing description is intended to illustrate and not to limit the scope of the invention, which is defined by the scope of the appended claims.

What is claimed is:

1. A face mask, comprising:

a main body for being worn to cover a mouth and nose of a wearer;

a right portion affixed to the main body along a right lateral extent of the main body, the right portion comprising elastic fabric provided between the main body, an upper elastic strap, a lower elastic strap, and a right adjustable strap; and a left portion affixed to the main body along a left lateral extent of the main body, the left portion comprising elastic fabric provided between the main body, an upper elastic strap, a lower elastic strap, and a left adjustable strap;

wherein the right adjustable strap comprises a continuous length of elastic material having opposing first and second ends and a first loop formed at the first end, wherein the second end is threaded through the first loop to form a right ear loop configured to be positioned around a right ear of the wearer, and wherein the second end is configured to be pulled to tighten the right ear loop around the right ear of the wearer;

wherein the left adjustable strap comprises a continuous length of elastic material having opposing first and second ends and a first loop formed at the first end, wherein the second end is threaded through the first loop to form a left ear loop configured to be positioned around the left ear of the wearer, and wherein the second end is configured to be pulled to tighten the left ear loop around the left ear of the wearer;

wherein the right adjustable strap forming the right ear loop is formed separately from and is independent of the left adjustable strap forming the left ear loop;

wherein the main body has a first predetermined extensibility and the elastic fabric of each of the right and left portions has a second predetermined extensibility, wherein the second predetermined extensibility is greater than the first predetermined extensibility;

wherein a diameter of the first loop of the right adjustable strap is less than a width of the right adjustable strap; and wherein a diameter of the first loop of the left adjustable strap is less than a width of the left adjustable strap.

2. The face mask according to claim 1, further comprising:

a second loop formed at the second end of the right adjustable strap securing a first fastening element to the second end of the right adjustable strap; and a second loop formed at the second end of the left adjustable strap securing a second fastening element to the second end of the left adjustable strap;

wherein the first fastening element is received in the second fastening element to secure the first and second fastening elements together.

3. The face mask according to claim 2, wherein the first fastening element comprises a tongue, the second fastening element comprises a buckle, and the second fastening element comprises an actuator for releasing the tongue from locked engagement in the buckle.

4. The face mask according to claim 2, wherein each of the first and second loops of each of the right and left adjustable straps is formed by folding over the respective end and sewing across a width of the respective end to form the respective loop.

5. The face mask according to claim 1, wherein the main body has a first predetermined porosity and the elastic fabric of each of the right and left portions has a second predetermined porosity, wherein the second predetermined porosity is greater than the first predetermined porosity.

6. The face mask according to claim 1, wherein the upper elastic strap of the right portion extends from the main body to the right adjustable strap, the lower elastic strap of the right portion extends from the main body to the right adjustable strap, the upper elastic strap of the left portion extends from the main body to the left adjustable strap, and the lower elastic strap of the left portion extends from the main body to the left adjustable strap.

7. The face mask according to claim 1, wherein the main body comprises at least two layers and each of the right and left portions comprise a single layer.

8. The face mask according to claim 1, further comprising an elongate malleable metal bar provided in an upper peripheral portion of the main body.

* * * * *